United States Patent [19]

Ebner et al.

[11] Patent Number: 4,906,181

[45] Date of Patent: Mar. 6, 1990

[54] LIQUIFIED GAS CONVEYING MEANS FOR COMBUSTION DEVICE

[75] Inventors: Richard Ebner, Waldems; Michael Haas, Kronberg; Gerhard Hildebrand, Steinbach; Joachim Manthey, Niedernhausen; Karl Öffinger, Oberursel; Walter Schäfer; Günther Seidel, both of Frankfurt am Main; Horst Urban, Kelkheim; Udo Milutzki, Mörfelden-Walldorf, all of Fed. Rep. of Germany

[73] Assignee: Braun Aktiengesellschaft, Kronberg, Fed. Rep. of Germany

[21] Appl. No.: 277,671

[22] Filed: Nov. 29, 1988

[30] Foreign Application Priority Data

Dec. 5, 1987 [DE] Fed. Rep. of Germany ..... 3741293

[51] Int. Cl.[4] ..... F23D 14/28

[52] U.S. Cl. ..... 431/344; 126/409

[58] Field of Search ..... 431/344, 276, 277, 130, 431/131, 142, 143, 150, 254, 255; 222/3; 62/52; 126/409

[56] References Cited

U.S. PATENT DOCUMENTS 3,413,070 11/1968 Piffath et al. ..... 222/3
4,361,133 11/1982 Bonnema .
4,416,298 11/1983 Berghammer .

FOREIGN PATENT DOCUMENTS 1457631 10/1969 Fed. Rep. of Germany ..... 431/344

*Primary Examiner*—Carroll B. Dority
*Attorney, Agent, or Firm*—Fish & Richardson

[57] ABSTRACT

A device for personal use includes a heating means that uses liquified petroleum gas, a gas container for liquified petroelum gas that has a longitudinal axis, and a vaporization element for supplying vaporized liquified petroelum gas from the gas container to the heating means. Non-porous structure in the gas container defines at least one capillary extending essentially transversely to the longitudinal axis of the gas container conveys liquified petroleum gas to the vaporization element.

15 Claims, 2 Drawing Sheets

LIQUIFIED GAS CONVEYING MEANS FOR COMBUSTION DEVICE

This invention relates to a device for personal use comprising a heating means or a means for producing a flame using liquefied petroleum gas, with a gas container and a vehicle provided in the gas container to convey the gas to a vaporization element.

A curling iron is already known (U.S. Pat. Specification No. 4,416,298) which is equipped with a heating device operated by means of a liquefied petroleum gas contained in a fuel tank. Several porous or fibrous aspirating means are provided in the tank as vehicle, serving to draw in liquefied petroleum gas and conveying it to a wick also if the tank is only partially filled with liquefied petroleum gas. The wick is received in a special holder and is connected with a burner element through a vaporization arrangement and valve device. The use of such aspirating disks is very complex and expensive because of assembly-related problems and contamination caused by mechanical attrition and soluble substances.

By contrast, it is an object of the present invention to provide a vehicle affording greater ease of manufacture at less cost and to improve upon it such as to permit ease of handling in assembly.

The vehicle is integrated into a disk serving at the same time to receive a wick member. This provides for an unproblematical direct transfer of the liquefied petroleum gas, independently of filling level and position. Such integration permits the vehicle to be manufactured at substantially reduced cost. In the absence of a wick member, the vehicle is also in a position to take care of the transfer of the liquefied petroleum gas to the vaporization element direct. In this arrangement, the vehicle can be advantageously formed fast with the disk or, alternatively, the vehicle and the disk may be integrally formed of a single solid material. In this case, at least one of the surfaces is advantageously equipped with a plurality of capillaries, which, with the gas container in horizontal position, conduct the liquefied petroleum gas to the centrally arranged wick member or to the vaporization element direct, even if the gas container has only very little liquefied petroleum gas left. It will be suitable in this arrangement to provide the surface with capillaries moistened with liquefied petroleum gas at any location, if possible, irrespective of the position of the appliance and of the tank filling level.

The capillaries may be provided on only one surface of the aspirating or carrier element, or, alternatively, they may be provided on both surfaces which extend parallel to one another transversely to the longitudinal axis of the appliance.

The capillaries may extend radially outwardly from the wick member which is arranged concentrically in the housing of the device or the gas container, reaching up to the inside wall of the gas container, so that with the gas container in a horizontal position also the remaining fuel can be directed to the wick member through the capillaries.

In a further advantageous embodiment of the invention, the individual vehicles may be formed by elevations, projections or knobs or cylindrical studs. In this embodiment, the individual elevations or projections are closely arranged side by side such as to form capilliform channels which perform the same function as rectilinear capillaries. If the carrier disk is a relatively thick structure, it is also possible to provide capillary bores in the disk for transfer of the liquefied petroleum gas.

Advantageously, the capillaries may also be formed by arranging two disks side by side in such close relationship that the space formed between the surfaces of the two opposed disks provides one or several capillaries.

In order to supply liquefied petroleum gas to the wick member at several locations or, alternatively, in order to obviate the need for a wick member altogether, capillaries may also be provided directly in the inside walls of the gas container. With this arrangement, the vehicle may be integrated into an inner bottom (or into both bottoms) of the gas container and include a plurality of radially outwardly extending capillaries conducting the liquefied petroleum gas directly or indirectly to the vaporization element or to the heating means or the means for producing a flame. In this manner, transfer of the liquefied petroleum gas is ensured in a simple manner with little constructional expenditure, because the liquefied petroleum gas is conveyed along the capillaries provided in the gas container until it reaches the combustion or heating chamber through a discharge orifice. This eliminates the necessity of a wick member which conventionally serves to supply liquefied petroleum gas, whereby substantial savings are realized. The capillaries may be provided in both bottoms of the gas container. Further, the capillaries may also be provided on the inner surfaces of the wall portions, s that also with the gas container in a horizontal position the transversely extending capillaries in the bottoms are reliably supplied with liquefied petroleum gas, thus ensuring the transfer of gas to the heating or combustion chamber.

The disk may be of a composite material, with the one part of the disk serving as supporting member while the other part of the disk which provides the vehicle is made of a porous material including a plurality of capillaries which serve the function of carrying the liquefied petroleum gas.

In a further advantageous embodiment of the invention, the vehicle is provided between two disks.

The assembly of the vehicle or of the disk can be simplified by sliding the vehicle onto the wick member prior to mounting the wick member in the gas container, thus enabling the two parts to be mounted in the gas container as a unit.

In contrast to known porous or fibrous aspirating elements, the capillary elements of the invention afford the substantial advantage of greater ease of assembly and better protection against contamination.

The invention will be explained in more detail in the following with reference to the accompanying drawings in which several embodiments are disclosed.

Figure 1:
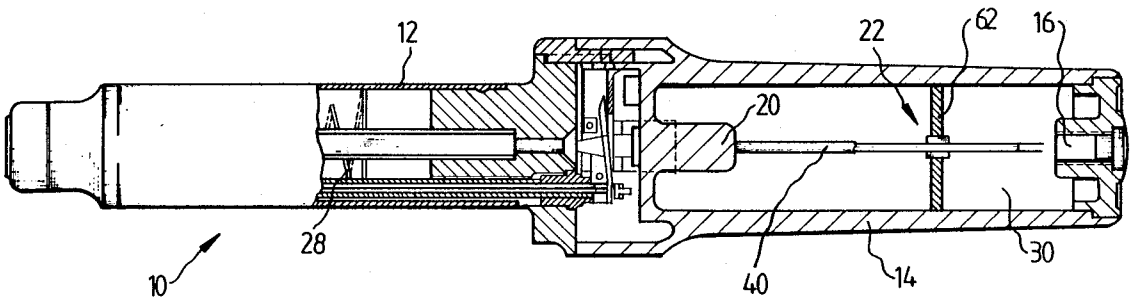
FIG. 1 is a sectional view of a curling iron including a gas container or holding liquefied petroleum gas, with a wick member being carried therein by means of disks.

Referring now to the drawings, reference numeral 10 identifies a curling iron which comprises a heatable tubular barrel 12 used, for example, for forming curls, and a handle portion 14 filled with liquefied petroleum gas; at its right-hand end, a refill valve 16 for the supply of liquefied petroleum gas is provided.

Concentrically arranged in the handle portion 14 which serves to receive the liquefied petroleum gas is a wick member 40 which is carried in a mounting means 20 connected with the handle member and is supported in the interior of the handle portion 14 by means of a supporting disk 62. A vehicle 22 is integrated into the supporting disk 62; it carries the liquefied petroleum gas to the wick member 40 whence it is passed through a vaporization element 26 shown in FIG. 2 to a heating means for a heating element 28.

Figure 2:
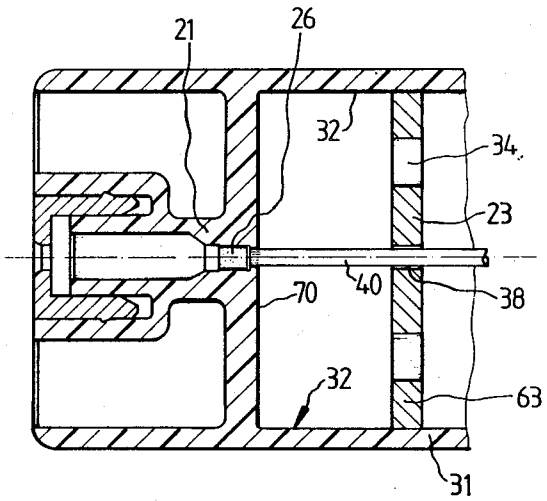
FIG. 2 is a view of a cartridge holding liquefied petroleum gas for use in a curling iron, for example, including a wick member carried in the cartridge by means of a disk.

FIG. 2 illustrates another embodiment. It involves a cartridge suitable, for example, for insertion in a curling iron or another appliance, with a heating means or a means for producing a flame. The cartridge is a cylindrical gas container 31 which is inserted into the appliance and is adapted to be coupled thereto by means of a valve, for example. For the sake of simplicity, only the left-hand part of the gas container 31 is illustrated in FIG. 2. Seated in the gas container 31 is a supporting disk 63 having the vehicle 23 integrated therein and bearing against the inside walls 32 of the gas container 31. The disk-shaped vehicle 23 is provided with bores 34, permitting even distribution of the liquefied petroleum gas in the gas container 31. The disk-shaped vehicle 23 includes a further bore 38 which extends concentrically with the longitudinal center axis of the curling iron or handle portion and receives a wick member 40. As becomes also apparent from FIG. 1, for example, the wick member 40 extends along the entire length of the respective gas container 30, 31, terminating in the respective mounting means 20, 21.

Situated in a centric bore provided in the mounting means 20, 21 is the vaporization element 26 which vaporizes the liquefied petroleum gas, feeding it to a heating element or to a means for producing a flame.

The disk-shaped vehicle 22, 23 may be, for example, a fleece-like fabric whose capillary effect causes liquefied petroleum gas to be fed to the wick member 40 also if the appliance assumes, for example, the horizontal position illustrated in FIG. 1 and if just the lower third of the gas container 30, 31 is filled with liquefied petroleum gas. In lieu of providing the vehicle 23 with a disk shape as shown in FIG. 2, the vehicle according to FIGS. 5 and 6 may be a ring 43 having bars 44 extending in spoke fashion. Overall, the disk-shaped vehicle 24 is made of a plastics material. In the two opposite surfaces 46, 48 of the bars 44, radially extending capillaries 50 are provided which converge in the bore 38 in which the wick member 40 is carried. The outer ends of the capillaries 50 extend up to the inside wall 32 of the gas container 31.

Figure 4:
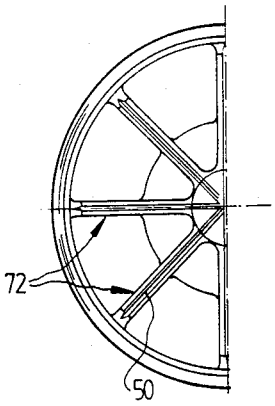
FIG. 4 is a section on the line 3—3 of FIG. 3.
Figure 3:
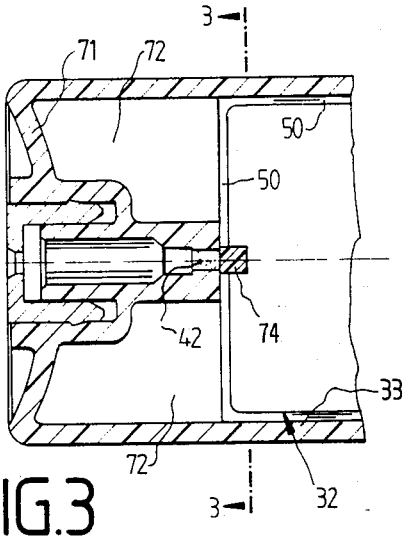
FIG. 3 is a sectional view of another embodiment of such a cartridge providing in its bottom or walls a plurality of radially extending capillaries.

In FIG. 2, the gas container 31 has both its ends bounded by a bottom 70. In the drawing of FIG. 2, only the left-hand bottom 70 of the gas container 31 is shown. On the inner surface of the bottom 70 (see FIG. 2) or on rib members 72 formed on the bottom 71 and extending into the inner chamber (see FIG. 3), a plurality of radially extending capillaries 50 may be provided which—as becomes apparent from FIG. 4—extend from the inside wall 32 of the gas container 33 up to the center of the bottom 70, 71 or the rib members 72. In addition, the possibility also exists to provide capillaries 50 in the longitudinal wall portion of the gas container and to connect them with the capillaries 50 in the rib members 72 of the gas container 33. In this manner, the transfer of liquefied petroleum gas to an orifice provided in the bottom 70, 71 and thus to a vaporization element 42 is ensured also with the gas container in a horizontal position. It will be understood that the capillaries need not be arranged on the bottom or rib surface; they may also be integrated into the walls, for example, as bores.

The capillaries 50 provided in the left-hand bottom may also be provided in the right-hand bottom (not shown in the drawings) of the gas container 33.

To aid in the transfer of the liquefied petroleum gas, a filter element 74 connecting with the capillaries 50 may be provided adjacent to the vaporization element 42 (see FIG. 3), the filter element serving approximately the function of the wick member 40 while at the same time performing a purifying function.

Figure 5:
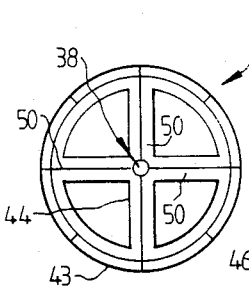
FIG. 5 is a view of a further embodiment of a disk with a vehicle integrated therein, with the individual capillaries being provided on the surface of the disk.
Figure 6:
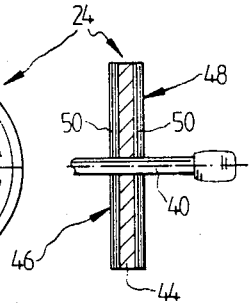
FIG. 6 is a side view of the embodiment of FIG. 5.
Figure 7:
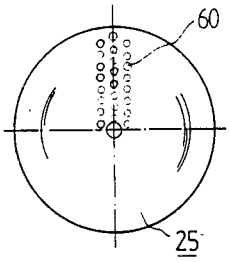
FIG. 7 is a view of a further embodiment of a vehicle having projections closely arranged on the surface side by side.
Figure 8:
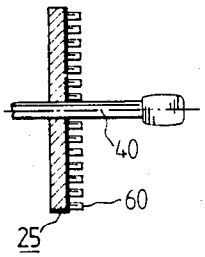
FIG. 8 is a side view of the embodiment of FIG. 7.

In lieu of the wheel-shaped carrying member 24 illustrated in FIG. 5, the vehicle 25 of FIGS. 7 and 8 may be a circular disk having on its surface a plurality of projections or knobs 60 closely arranged side by side which, because of their closely packed arrangement, provide capilliform channels on the surface, thus ensuring the transfer of liquefied petroleum gas. The knobs 60 may be provided on either surface. The vehicle 25 equally serves to receive the wick member 40 concentrically therewith.

Figure 9:
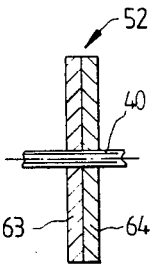
FIGS. 9 to 11 are views of relatively spaced disks having capillaries provided therebetween.
Figure 10:
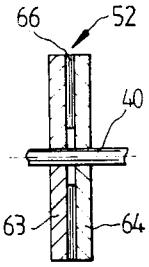

In the embodiment of FIG. 9, two supporting disks 63 and 64 are arranged side by side in such close relationship that the space provided therebetween forms one or several capillaries 52. According to FIG. 10, spacing means 66 maintaining a minimum space between the two supporting disks 63 and 64 may be provided in the space described with reference to FIG. 9.

Figure 11:
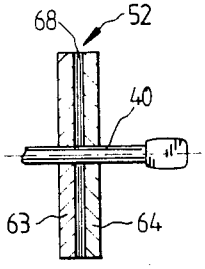

Moreover, in accordance with FIG. 11, a fleece fabric 68 may be provided in the space which, because of its capillary effect, is substituted for the capillary channels described.

What is claimed is:

1. A device for personal use comprising a heating means using liquefied petroleum gas, a gas container for liquefied petroleum gas, said container having a longitudinal axis, a vaporization element for supplying vaporized liquefied petroleum gas from said gas container to said heating means, and non-porous structure in said gas container to convey the liquified petroleum gas to said vaporization element, said nonporous structure defining at least one capillary extending essentially transversely to the longitudinal axis of said gas container for supplying liquefied petroleum gas to said vaporization element.

2. A device as claimed in claim 1, and further including a wick member arranged concentrically in said gas container, and wherein said nonporous structure includes a plurality of capillaries that extend radially outwardly from the wick member and reach to the inside wall of said gas container.

3. A device as claimed in claim 1 wherein said nonporous structure includes a support disc and a plurality of capillaries are provided on opposite surface of said support disc, said surfaces of said disc extending transversely to the longitudinal axis of said gas container.

4. A device as claimed in claim 1 wherein said nonporous structure includes a plurality of capillaries that are formed by a plurality of projections or knobs closely arranged side by side on the surface of said nonporous structure.

5. A device as claimed in claim 1 wherein said nonporous structure includes at least two disks arranged side by side in such close relationship that the space remaining therebetween provides one or several capillaries.

6. A device as claimed in claim 1 wherein said nonporous structure includes a plurality of capillaries arranged on the surface of bars of a disk.

7. A device as claimed in claim 1 wherein said heating means includes means for producing a flame.

8. A device according to claim 1 wherein said nonporous structure is integrated into said gas container and has a plurality of capillaries extending approximately radially outwardly from said vaporization element to the inside walls of said gas container.

9. A device as claimed in claim 8 wherein said capillaries are arranged on rib members that project into said gas container, said capillaries extending approximately radially from said vaporization element which is concentrically arranged in said gas container.

10. A device as claimed in claim 8 and further including capillaries arranged in said side wall portion of said gas container, said capillaries in said side wall communicating with the capillaries in said nonporous structure.

11. A device as claimed in claim 1 wherein said nonporous structure includes a plurality of capillaries and a filter element is provided in the area of transition between said capillaries and said vaporization element.

12. A device as claimed in claim 1 and further including a wick member arranged concentrically in said gas container, and wherein said nonporous structure includes a plurality of capillaries on an outer surface that extends transversely to the longitudinal axis of said gas container, said capillaries extending radially outwardly from said wick member to the inside wall of said gas container.

13. A device as claimed in claim 1, wherein said nonporous structure includes two opposed surfaces that extend transversely to the longitudinal axis of said gas container, and a plurality of capillaries on each said surface.

14. A device as claimed in claim 1 and further including a wick member arranged concentrically in said gas container, and wherein said nonporous structure includes an outer surface that extends transversely to the longitudinal axis of said gas container, and a plurality of capillaries that extend radially outwardly from said wick member, said capillaries reaching up to the inside wall of said gas container.

15. A device as claimed in claim 1 and further including a wick member arranged concentrically in said gas container, and wherein said nonporous structure includes two disks and a plurality of capillaries between said disks that extend radially outwardly from said wick member to the inside wall of said gas container.

* * * * *